US008173854B2

(12) United States Patent
McCoy et al.

(10) Patent No.: US 8,173,854 B2
(45) **Date of Patent: *May 8, 2012**

(54) STEAM CRACKING OF PARTIALLY DESALTED HYDROCARBON FEEDSTOCKS

(75) Inventors: James N. McCoy, Houston, TX (US); Arthur R. DiNicolantonio, Seabrook, TX (US); Richard C. Stell, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 860 days.

This patent is subject to a terminal disclaimer.

(21) Appl. No.: 11/172,096

(22) Filed: Jun. 30, 2005

(65) Prior Publication Data

US 2007/0004952 A1 Jan. 4, 2007

(51) Int. Cl.
*C07C 4/02* (2006.01)

(52) U.S. Cl. ..... 585/648; 585/650; 516/143; 208/129; 208/130; 208/132

(58) Field of Classification Search ..... 208/129, 208/130, 132; 516/143; 585/648, 650
See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | |
| 2,091,261 | A | 8/1937 | Alther | |
| 2,158,425 | A | 5/1939 | Ragatz | |
| 2,221,518 | A * | 11/1940 | Jennings | 516/196 |
| 2,446,040 | A * | 7/1948 | Blair, Jr. | 516/143 |
| 2,703,308 | A * | 3/1955 | Oblad et al. | 208/60 |
| 3,291,573 | A | 12/1966 | Frescoln | |
| 3,341,429 | A | 9/1967 | Fondrk | |
| 3,376,977 | A * | 4/1968 | Gordon et al. | 210/114 |
| 3,413,211 | A | 11/1968 | Becraft et al. | |
| 3,487,006 | A | 12/1969 | Newman et al. | |
| 3,492,795 | A | 2/1970 | Guerrieri | |
| 3,505,210 | A | 4/1970 | Wallace et al. | |
| 3,594,137 | A | 7/1971 | Lonstrup | |
| 3,617,493 | A | 11/1971 | Wirth et al. | |
| 3,677,234 | A | 7/1972 | Dutkiewicz | |
| 3,718,709 | A | 2/1973 | Simonetta | |
| 3,900,300 | A | 8/1975 | Lehman | |
| 4,199,409 | A | 4/1980 | Skraba | |
| 4,264,432 | A | 4/1981 | Gartside | |

(Continued)

FOREIGN PATENT DOCUMENTS

DE 1 093 351 11/1961

(Continued)

OTHER PUBLICATIONS

"Specialty Furnace Design: Steam Reformers and Steam Crackers", presented by T.A. Wells of the M.W. Kellogg Company, 1988 AIChE Spring National Meeting.

(Continued)

*Primary Examiner* — Prem C Singh
(74) *Attorney, Agent, or Firm* — Brent R. Knight

(57) ABSTRACT

A process for cracking a hydrocarbon feedstock containing salt and/or particulate matter, wherein said hydrocarbon feedstock containing salt and/or particulate matter is partially desalted, e.g., by passing through a centrifugal separator, heated, then separated into a vapor phase and a liquid phase by flashing in a flash/separation vessel, separating and cracking the vapor phase which comprises less than about 98% of the hydrocarbon feedstock containing salt and/or particulate matter, and recovering cracked product.

28 Claims, 1 Drawing Sheet

U.S. PATENT DOCUMENTS

| | | | | |
|---|---|---|---|---|
| 4,300,998 | A | 11/1981 | Gartside | |
| 4,311,580 | A | 1/1982 | Bartholic | |
| 4,361,478 | A | 11/1982 | Gengler et al. | |
| 4,400,182 | A | 8/1983 | Davies et al. | |
| 4,426,278 | A | 1/1984 | Kosters | |
| 4,444,697 | A | 4/1984 | Gater et al. | |
| 4,543,177 | A | 9/1985 | Murthy et al. | |
| 4,615,795 | A | 10/1986 | Woebcke et al. | |
| 4,714,109 | A | 12/1987 | Tsao | |
| 4,732,740 | A | 3/1988 | Woebcke et al. | |
| 4,840,725 | A | 6/1989 | Paspek | |
| 4,854,944 | A | 8/1989 | Strong | |
| 4,954,247 | A | 9/1990 | Lipkin et al. | |
| 5,096,567 | A | 3/1992 | Paspek, Jr. et al. | |
| 5,120,892 | A | 6/1992 | Skraba | |
| 5,141,906 | A | 8/1992 | Takeshima et al. | |
| 5,190,634 | A | 3/1993 | Fernandez-Baujin et al. | |
| 5,468,367 | A | 11/1995 | Dickakian | |
| 5,580,443 | A | 12/1996 | Yoshida et al. | |
| 5,643,469 | A | 7/1997 | Prevost et al. | 210/787 |
| 5,817,226 | A | 10/1998 | Lenglet | |
| 5,910,440 | A | 6/1999 | Grossman et al. | |
| 6,093,310 | A | 7/2000 | Swan | |
| 6,123,830 | A | 9/2000 | Gupta et al. | |
| 6,179,997 | B1 | 1/2001 | Vedder, Jr. et al. | |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,376,732 | B1 | 4/2002 | Ngan et al. | |
| 6,632,351 | B1 * | 10/2003 | Ngan et al. | 208/132 |
| 6,743,961 | B2 | 6/2004 | Powers | |
| 7,247,765 | B2 | 7/2007 | Stell et al. | |
| 7,408,093 | B2 | 8/2008 | Stell et al. | |
| 2001/0016673 | A1 | 8/2001 | Bridges et al. | |
| 2003/0070963 | A1 | 4/2003 | Zimmermann et al. | |
| 2004/0004022 | A1 | 1/2004 | Stell et al. | |
| 2004/0004027 | A1 | 1/2004 | Spicer et al. | |
| 2004/0004028 | A1 | 1/2004 | Stell et al. | |
| 2004/0039240 | A1 | 2/2004 | Powers | 585/652 |
| 2004/0054247 | A1 | 3/2004 | Powers | |
| 2005/0010075 | A1 | 1/2005 | Powers | |
| 2005/0209495 | A1 | 9/2005 | McCoy et al. | |

FOREIGN PATENT DOCUMENTS

| | | |
|---|---|---|
| EP | 0 063 448 | 10/1982 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 5/1979 |
| GB | 2 012 176 | 7/1979 |
| JP | 3111491 | 5/1991 |
| NL | 7410163 | 4/1975 |
| SU | 1491552 | 7/1989 |
| WO | WO 01/55280 | 8/2001 |
| ZA | 907394 | 7/1991 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16.

* cited by examiner

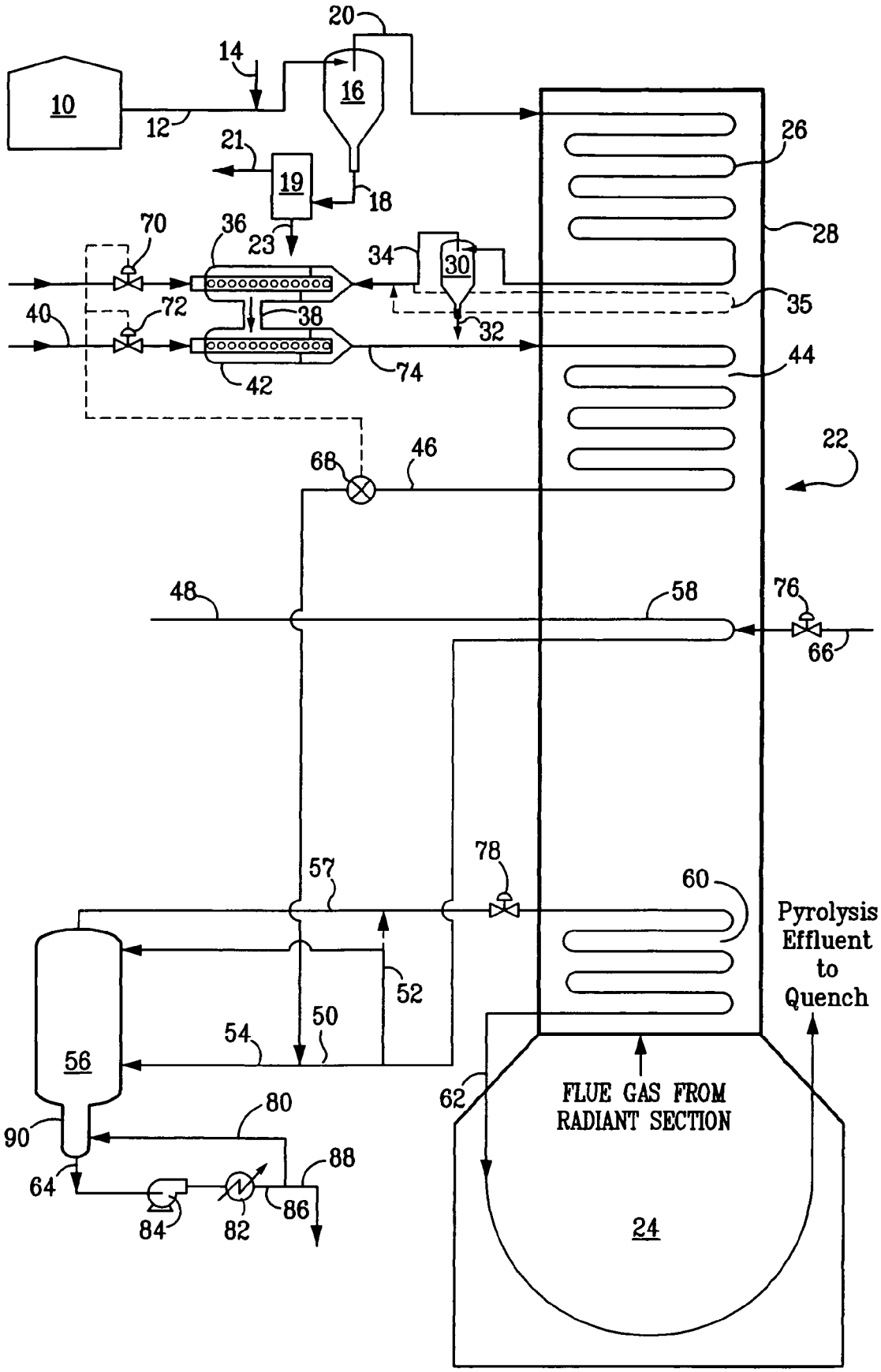
10
12
14
16
18
19
20
21
22
23
24
26
28
30
32
34
35
36
38
40
42
44
46
48
50
52
54
56
57
58
60
62
64
66
68
70
72
74
76
78
80
82
84
86
88
90
Pyrolysis Effluent to Quench
FLUE GAS FROM RADIANT SECTION

STEAM CRACKING OF PARTIALLY DESALTED HYDROCARBON FEEDSTOCKS

FIELD OF THE INVENTION

The present invention relates to the steam cracking of hydrocarbon feedstocks that contain salt and/or particulate matter.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light low molecular weight feedstocks which enter as a vapor) wherein it is typically heated and vaporized by indirect contact with hot flue gas from the radiant section and, to a lesser extent, by direct contact with steam. The vaporized feedstock and steam mixture is then introduced into the radiant section where the cracking takes place. Pyrolysis involves heating the feedstock sufficiently to cause thermal decomposition of the larger molecules. The resulting products including olefins leave the pyrolysis furnace for further downstream processing, including quenching.

Crude oil, as produced from the reservoir, is typically accompanied by some volume of saltwater and particulate matter, also known as sediment or mud, from the reservoir formation. As used herein, the term "particulate matter" includes mud, mud blends, mud particles, sediment and other particles included in the hydrocarbon feedstock. Crude oils are complex mixtures containing many different hydrocarbon compounds that vary in appearance and composition from one oil field to another. Crude oils range in consistency, e.g., viscosity, from water-like to tar-like solids, and in color from clear to black. A typical crude oil can contain about 84% carbon, 14% hydrogen, 1%-3% sulfur, and less than 1% each of nitrogen, oxygen, and even lesser amounts of metals, and dissolved salts. Refinery crude base stocks usually consist of mixtures of two or more different crude oils.

Field separation is used to remove the bulk of the saltwater and particulate matter, but some small quantity typically remains in the crude and is reported as basic sediment and water (BS&W) in reporting crude oil quality. Undesalted crude is sometimes processed in a refinery atmospheric pipestill in which the salt and particulate matter will concentrate in the bottoms fraction (atmospheric residue) from distillation of the crude. Additionally, crude or undesalted atmospheric residue can be further contaminated with salt prior to processing by contact with sea water during shipping. Prior to refining, the crude oil, or a bottoms fraction from distillation of the crude oil, is generally passed through a desalter which uses heat, clean water, and an electric current to break the emulsion, thereby releasing water and particulate matter from the suspension or emulsion with the crude oil or bottoms fraction. The salt and some of the particulate matter leave with the desalter effluent water. Some of the particulate matter remains on the bottom of the desalter vessel and is periodically cleaned out. The desalted crude or residue fraction derived from crude leaving the desalter is very low in salt and particulate matter. Highly effective desalters which employ electric current can typically remove more than about 90% of the salts present in raw crude.

In a situation where crude oil, atmospheric residue, or any other hydrocarbon feedstock containing salt and/or particulate matter is used as the feedstock for a reactor, a conventional desalter employing an electrostatic field would constitute a significant additional facility investment. Using undesalted crude oil or undesalted atmospheric residue as a feedstock in a conventional cracking furnace would, however, result in deposition of salt (primarily NaCl) and particulate matter as the liquid hydrocarbon feedstock was vaporized for cracking. Any non-volatile hydrocarbons would cause rapid coking around the dry point. The salt and particulate matter which also lay down causes corrosion and fouling of the convection tubes. Moreover, any salt remaining in the feed after the dry point and deposited in the radiant section of the furnace would result in removal of the protective oxide layer on the radiant tubes. Therefore, provisions must be taken to remove salt and particulate matter, to an extent sufficient to prevent damage in the furnace.

Conventional steam cracking systems have been effective for cracking high-quality feedstocks, which contain a large fraction of volatile hydrocarbons, such as gas oil and naphtha. However, steam cracking economics sometimes favor cracking lower cost heavy feedstocks such as, by way of non-limiting examples, crude oil, and atmospheric residue. Crude oil and atmospheric residue often contain high molecular weight, non-volatile components with boiling points in excess of 590° C. (1100° F.) otherwise known as asphaltenes, bitumen, or resid. The non-volatile components of these feedstocks lay down as coke in the convection section of conventional pyrolysis furnaces. Only very low levels of non-volatile components can be tolerated in the convection section downstream of the dry point where the lighter components have fully vaporized.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 and 1100° F. (230 and 590° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

U.S. patent application Ser. No. 10/188,461, filed Jul. 3, 2002, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. The amount of fluid mixed with the feedstock is varied in accordance with a selected operating parameter of the process, e.g., temperature of the mixture stream before the mixture stream is flashed, the pressure of the flash, the flow rate of the mixture stream, and/or the excess oxygen in the flue gas of the furnace.

U.S. patent application Ser. No. 10/975,703, filed Oct. 28, 2004, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins, which uses an undesalted hydrocarbon feed to the convection section of a steam cracking furnace, and effects desalting downstream of the furnace inlet in a flash drum treating preheated feed.

While the references address the use of heavier hydrocarbon feedstocks, none of the references address the possibility of using a partially undesalted hydrocarbon feedstock for a cracking furnace. It has now surprisingly been found that it is possible to operate a steam cracking furnace with a hydrocarbon feedstock containing salt and/or particulate matter. This is particularly advantageous when the feedstock additionally contains non-volatile components.

SUMMARY OF THE INVENTION

The present invention relates to a process for cracking a hydrocarbon feedstock containing salt and particulate matter. The process comprises: (a) heating said hydrocarbon feedstock containing salt and particulate matter to provide a heated hydrocarbon feedstock containing salt and particulate matter; (b) optionally adding steam and/or water to said heated hydrocarbon feedstock containing salt and particulate matter; (c) feeding the hydrocarbon feedstock containing salt and/or particulate matter and optionally added steam to a flash/separation vessel; (d) separating the hydrocarbon feedstock containing salt and/or particulate matter into a vapor phase and a liquid phase, said liquid phase comprising a sufficient portion of the hydrocarbon feedstock to maintain salt and/or particulate matter in suspension; (e) removing the vapor phase from the flash/separation vessel; (f) cracking the vapor phase to produce an effluent comprising olefins; and (g) partially desalting upstream of step (b) which, for present purposes, can also include upstream of step (a), said hydrocarbon feedstock containing salt and particulate matter to an extent sufficient to avoid at least one of: (1) deposition of salt and particulate matter by the feedstock upstream of the flash separation vessel and (2) accumulation of salt and particulate matter in said liquid phase at levels which interfere with the subsequent intended use of the liquid phase.

In another aspect, the present invention relates to a process for cracking a hydrocarbon feedstock containing salt, said process comprising: (a) heating said hydrocarbon feedstock containing salt to a first temperature; (b) adding steam and/or water to the hydrocarbon feedstock containing salt; (c) further heating the hydrocarbon feedstock containing salt to a second temperature greater than the first temperature, said second temperature being such that a sufficient portion of the hydrocarbon feedstock containing salt remains in the liquid phase to maintain salt in suspension; (d) feeding the hydrocarbon feedstock containing salt to a flash/separation vessel; (e) separating the hydrocarbon feedstock containing salt into a vapor phase and a liquid phase, said liquid phase being rich in salt and said vapor phase being substantially depleted of salt; (f) removing the vapor phase from the flash/separation vessel; (g) adding steam to the vapor phase; (h) cracking the vapor phase in a radiant section of a pyrolysis furnace to produce an effluent comprising olefins, said pyrolysis furnace comprising a radiant section and a convection section; and (i) partially desalting upstream of step (b) said hydrocarbon feedstock containing salt to an extent sufficient to avoid at least one of: (1) deposition of salt from the feed upstream of the flash separation vessel and (2) accumulation of salt and/or particulate matter in said liquid phase at levels which interfere with the subsequent intended use of said liquid phase.

Typically, partial desalting can be carried out to an extent sufficient to remove less than about 95 wt %, say, less than about 90 wt %, less than about 75 wt %, less than about 50 wt %, or even less than about 25 wt % of said salt and/or particulate matter. The partially desalted hydrocarbon feedstock typically contains from about 0.01 to about 0.8 wt % salt and/or particulate matter, say, from about 0.1 to about 0.5 wt % salt and/or particulate matter.

A primary advantage of partial desalting in accordance with the present invention is that it allows the use of simpler, less expensive desalters. The main function of a desalter is to remove salt and water form the crude oil. However, many other contaminants such as clay, silt, rust, and other debris also need to be removed. Typical desalters, which extensively desalt crude oil feeds, require demulsifying the crude oil containing inherit water with chemical demulsifiers and wash water. The desalter removes contaminants from crude oil by first mixing water with the crude to provide a water phase. The salts containing some of the metals that can poison catalysts are dissolved in the water phase. After the oil has been washed and mixed as an emulsion of oil and water, demulsifying chemicals are then added and high voltage electrostatic charges are used to break the emulsion to coalesce and concentrate suspended water globules in the bottom of the settling tank. Surfactants are added only when the crude has a large amount of suspended solids. Desalters are typically sized to allow the water and oil to settle and separate. Wastewater and contaminants are discharged from the bottom of the settling tank to the wastewater treatment facility. The desalted crude is continuously drawn from the top of the settling tank and sent on for further processing. A properly performing desalter can remove more than about 90% of the salt in raw crude.

The present invention requires less extensive desalting than is normally required for treating crude oil feeds, given that salt and particulates are introduced to the steam cracking furnace under preheating conditions which avoid the dry point at which such salts and particulates begin fouling the convection surfaces in the furnace used in preheating. Moreover, the present invention provides for additional removal of salt and particulates from the preheated stream in a flash/separation vessel prior to additional convection heating and radiant heating in the furnace, to an extent sufficient to prevent fouling downstream of the flash/separation vessel.

It has now been found that simple, less efficient desalters can be employed in the process of the present invention. Desalters utilizing centrifugal force to effect desalting and particulate removal have been found particularly effective in achieving the desired results of the present invention. Such desalters achieve the required partial desalting by using centrifugal force to separate components of a feedstream. Although centrifugal separators which require the addition of energy to effect generation of centrifugal force, e.g., by means of a centrifuge, can be utilized in the present invention, passive centrifugal separators which do not require the additional input of energy are preferred. In particular, the use of a cyclone separator is especially preferred. Thus, partial desalting according to the present invention can be carried out in the absence of an electrostatic charge. In a particularly preferred embodiment, the centrifugal separator is a cyclone separator comprising a tangential inlet, an upper outlet for removing a desalted hydrocarbon stream and a lower outlet for removing bottoms containing water, salt and/or particulate matter bottoms. The bottoms can be removed to a dewatering tank to separate particulate matter from said water and salt, and the particulate matter can be treated to at least partially remove hydrocarbons.

In an embodiment of the present invention, a cyclone separator is employed which typically comprises a drum having a tangential inlet to spin the hydrocarbon feedstock to remove heavier components by centrifugal force, the hydrocarbon portion of a crude oil having a lower density than the mud and water portion. The motion in the cyclone separator drum consists of two vortices: an outer vortex moving downward and an inner vortex flowing upwards and out the exit at the top. In the outer vortex, the tangential velocity increases with decreasing radius. The radius of the cyclone separator decreases and the velocity of the liquid increases as it moves down the cone of the lower section of the cyclone separator drum. The heavier mud and water are thrown to the separator wall by centrifugal force and flow out the exit at the bottom of the separator cone where the outer vortex meets the inner vortex. The mud-free hydrocarbon stream in the inner vortex flows out the vent stack at the top of the separator and is routed to the desalter and then to the convection section of the furnace.

The centrifugal separator can be positioned at any location between a source of undesalted hydrocarbon feedstock and the flash/separation apparatus inlet. Preferably, the centrifugal separator is located between the source of the undesalted hydrocarbon feedstock and the point at which additional steam or other fluid is added to the feedstock preheated in the convection section of the pyrolysis furnace (steam cracking furnace). In another embodiment, the centrifugal separator is located at a point between the source of undesalted hydrocarbon feedstock and the inlet to the first convection section of the pyrolysis furnace. Preferably, the centrifugal separator is located downstream of a point at which water is introduced to the undesalted hydrocarbon feedstock, upstream of the pyrolysis furnace feed inlet. Thus, the present invention can comprise mixing wash water with the hydrocarbon feedstock prior to the partial desalting step.

Optionally, water can be introduced to the undesalted hydrocarbon feedstock through a water spray nozzle or a mixing valve installed in the undesalted hydrocarbon feedstock feed line to the furnace. The resulting water saturated undesalted hydrocarbon feedstock is then directed to the partial desalter, e.g., centrifugal separator, say, a cyclone separator drum, while the partially desalted overhead stream from the separator is routed to the furnace. The bottoms stream from the partial desalter, which is rich in water, mud, and salt, can be sent to a settling tank or a dewatering tank where water is drawn off from the top of the tank and sent to a water processing plant. The bottoms of the tank, rich in mud, can be treated to recover hydrocarbons, e.g., by stripping or by a liquid/liquid separator where hydrocarbons are recovered as a separate phase from the water/salt/mud phase, and the water/salt/mud phase can be further treated before the solids are disposed of in an environmentally acceptable manner.

Where the centrifugal separator is located upstream of the furnace, the partially desalted overhead stream is directed to the preheater portion of the furnace where it undergoes convection heating by contact with an upper portion of a convection tube bank, prior to being directed to an optional additional centrifugal separator and thence to a sparger for mixing with steam and thence to a lower part of the convection tube bank in the pyrolysis furnace and thence to a flash/separation vessel. Of course, in that embodiment in which partial desalting is carried out only with the centrifugal separator immediately upstream of the sparger, the overhead from that separator passes immediately to the sparger, where steam is added, prior to reintroduction for additional convection heating before introduction to the flash/separation vessel.

Preferably, the liquid phase in the flash/separation vessel comprises at least about 2%, for example, about 5%, of the hydrocarbon feedstock containing salt and/or particulate matter and/or non-volatile components. If necessary to maintain this condition, e.g. when the hydrocarbon feedstock is relatively light, such as a light crude mixed with condensate, heavy hydrocarbon feedstock may be added to the heavy hydrocarbon feedstock containing salt and/or particulate matter and/or non-volatile components. The addition of heavy hydrocarbon feedstock reduces the deposition of salt and/or particulate matter in and upstream of the flash/separation vessel and ensures that the liquid stream leaving the flash/separation vessel comprises a sufficient percentage of the total hydrocarbon feedstock to avoid deposition of salt, particulate matter, and non-volatiles of the feed upstream of the flash separation vessel.

BRIEF DESCRIPTION OF THE DRAWING

FIG. 1 illustrates a schematic flow diagram of the overall process and apparatus in accordance with the present invention employed with a pyrolysis furnace, wherein a partial desalter comprising a centrifugal separator located at a point upstream from where steam or other fluid is injected into the feedstream preheated in a first convection section of the pyrolysis furnace.

DETAILED DESCRIPTION OF THE INVENTION

Unless otherwise stated, all percentages, parts, ratios, etc., are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, non-volatile components are the fraction of a hydrocarbon stream with a nominal boiling point above 590° C. (1100° F.) as measured by ASTM D-6352-98 or D-2887. This invention works very well with non-volatile components having a nominal boiling point above 760° C. (1400° F.). The boiling point distribution of the hydrocarbon stream is measured by Gas Chromatograph Distillation (GCD) according to the methods described in ASTM D-6352-98 or D-2887, extended by extrapolation for materials boiling above 700° C. (1292° F.). Non-volatile components can include coke precursors, which are moderately heavy and/or reactive molecules, such as multi-ring aromatic compounds, which can condense from the vapor phase and then form coke under the operating conditions encountered in the present process of the invention. $T_{50}$ as used herein shall mean the temperature, determined according to the boiling point distribution described above, at which 50 weight percent of a particular hydrocarbon sample has reached its boiling point. Likewise $T_{95}$ or $T_{98}$ mean the temperature at which 95 or 98 weight percent of a particular sample has reached its boiling point. Nominal final boiling point shall mean the temperature at which 99.5 weight percent of a particular sample has reached its boiling point.

The hydrocarbon feedstock for use in the present invention typically comprises one or more of gas oils, heating oil, diesel, hydrocrackate, Fischer-Tropsch liquids, distillate, heavy gas oil, steam cracked gas oil and residues, crude oil, atmospheric pipestill bottoms, vacuum pipestill streams including bottoms, heavy non-virgin hydrocarbon streams from refineries, vacuum gas oils, low sulfur waxy residue, heavy waxes, atmospheric residue, and heavy residue and further comprises salt and/or particulate matter.

For ease of reference herein, the term "undesalted" will be understood to mean that a feedstock contains salt(s) and/or particulate matter that would conventionally be removed in a desalter, whether the salt and/or particulate matter was present in the produced crude oil stream or a hydrocarbon feedstock contaminated during shipping and handling. In a preferred embodiment, the hydrocarbon feedstock comprising salt and/or particulate matter, or undesalted hydrocarbon feedstock, further comprises non-volatile components. The salt typically comprises primarily sodium chloride, with lesser amounts of potassium chloride, and/or magnesium chloride.

The term "partially desalted" will be understood to mean that a feedstock has been treated to remove a portion of salt(s) and/or particulate matter that would conventionally be removed in a desalter, whether the salt and/or particulate matter was present in the produced crude oil stream or was a contaminant added to a hydrocarbon feedstock during shipping and handling. In a preferred embodiment, the hydrocarbon feedstock comprising salt and/or particulate matter, or undesalted hydrocarbon feedstock, further comprises non-volatile components. The salt typically comprises primarily sodium chloride, with lesser amounts of potassium chloride, and/or magnesium chloride.

In one embodiment of the present invention, the undesalted stream can be partially desalted to an extent sufficient to avoid deposition of salt(s), particulate matter, and/or non-volatiles of the feed upstream of the flash separation vessel. Typically, desalting feeds to levels which contain less than about 1 wt % salt(s), particulate matter, and/or non-volatiles, preferably, less than about 0.1 wt % salt(s), particulate matter, and/or non-volatiles, or even more preferably, less than about 0.01 wt % salt(s), particulate matter, and/or non-volatiles, suffices to avoid such deposition.

In another embodiment of the present invention, the undesalted stream can be partially desalted to an extent sufficient to avoid accumulation of salt and/or particulate matter in the liquid phase collecting as bottoms in the flash/separation vessel, at levels which interfere with the subsequent intended use of said liquid phase. Such bottoms can be intended for various uses including as fuel oil, e.g., bunker C fuel oil, feed to a refinery catalytic cracker, or feed to a coker unit. Generally, bunker C fuel oil requires no greater than about 0.1 wt % ash and 1 wt % BS&W. Thus, partial desalting upstream of the flash/separation vessel in accordance with the invention can obviate any need to effect desalting of the liquid phase taken from the flash/separation vessel.

Aside from physical blockage due to deposition in the exchanger tubes of the steam cracker furnace, sodium can cause corrosion of the convection tubes and removal of the radiant tube protective oxide layer. For this reason, sodium (and salt) concentrations in the feed to a pyrolysis furnace must be controlled carefully.

Because of the extremely low acceptable concentration of sodium in the radiant section of steam cracking furnaces, it is usual to purchase a desalter for removing the salt and particulate matter from crude or crude residues prior to steam cracking. While acceptable salt and/or particulate matter concentrations will vary with furnace design, desalters are generally considered necessary when sodium chloride is greater than a few ppm by weight of the feedstock, depending on the operating conditions for a given feedstock. However, if a flash/separation vessel is used upstream of the dry point for the hydrocarbon stream, it is possible to operate in such a way that undesalted crude and crude residues can be used as a feedstock to a hydrocarbon cracking unit. Indications are that sodium in the vapor phase can be controlled within acceptable limits, and that virtually all of the salt and particulate matter will remain in the liquid phase in a flash/separation vessel as long as less than about 98% of the hydrocarbon is a vapor at the inlet of the flash/separation vessel.

One objective of this invention is to maintain sufficient liquid velocity at all points in the convection section upstream of the flash/separation vessel such that the salt and/or particulate matter contained in the undesalted hydrocarbon feedstock remain in suspension until they are removed in the liquid phase leaving the flash/separation vessel. Upstream of the addition of steam or other fluids, the undesalted hydrocarbon feedstock will be primarily in the liquid phase and will generally have sufficient turbulence to maintain the salt and/or particulate matter in suspension. Once the hydrocarbon feedstock containing salt and/or particulate matter is mixed with dilution steam, the total flow stream will have enough velocity, kinetic energy, and turbulence to keep the particulate matter and salt moving through the convection section upstream of the flash/separation vessel as long as a sufficient portion of the stream is liquid. The liquid fraction required will vary with the properties of the hydrocarbons remaining in the liquid phase, the velocity of the flow stream, and the quantity of salt and/or particulate matter in the flow stream. Lower liquid fractions are required for more viscous, generally heavier, liquid phase hydrocarbons. A higher liquid fraction would be required if the flow stream velocity were relatively low. Generally, maintaining about 2% of the total hydrocarbon, on a weight basis, in the liquid phase would be sufficient to maintain salt and or particulate matter in suspension. A 5% liquid cut would often be preferred.

If no deposits form in the tubes upstream of the flash/separation vessel, then the salt and particulate matter can be removed with the bottoms liquid stream from the flash/separation vessel. The liquid phase could then be sold as bunker C fuel oil or fed to a refinery catalytic cracker or coker unit without desalting. If a cleaner bottoms liquid stream is required, for example, as fuel to a boiler, a small desalter can be used to remove the salt and particulate matter in the flash/separation vessel bottoms liquid stream at a cost far less than would be required for desalting the total feed to the furnace. This process would allow cracking crude oils, residues derived from crudes, and other hydrocarbon feedstocks containing salt and/or particulate matter by using a flash/separation vessel without the investment required for extensive upfront desalting.

Should liquid velocities through the upper convection section before the flash/separation vessel ever be so low that salt and/or particulate matter did deposit in these tubes thus reducing heat transfer, it would be possible in most systems to flush the tubes with water during typical operations, including decoking operations.

Much of the salt in undesalted crude or crude residue comprises sodium chloride. The chloride portion of the salt is not problematic when the salt is in the solid phase or when the chloride, as HCl, is in the vapor phase. However, if water is mixed with the undesalted feed at the top of the convection section, the sodium and chloride will dissociate. The chloride ions formed when mixed with water can cause stress corrosion cracking of stainless steel in the convection rows where water is present, until the water completely vaporizes. Although injected water can be used to control temperature, thereby controlling the vapor liquid split in the flash/separation vessel, it is preferred for this invention that the vapor liquid split in the flash/separation vessel be controlled by using variable levels of steam as a diluent, by varying furnace excess air, and/or by mixing in a heavier hydrocarbon feedstock if necessary to maintain the desired vapor liquid split in the flash/separation vessel.

Potassium chloride is also present in some crude oils and its effects are similar to those of sodium chloride. Magnesium chloride also generally carries the same risks as sodium chloride, but magnesium is less harmful to the furnace than sodium. All of these salts can be removed using the process of this invention.

In order to prevent deposition of salt and/or particulate matter in the convection section tubes banks and the flash/separation vessel, it is preferable to operate the flash/separation vessel at conditions such that at least about 2% of the hydrocarbon stream remains in the liquid phase at all points upstream of the flash/separation vessel. In some cases a partially undesalted hydrocarbon feedstock may not have a sufficient quantity of high molecular weight or low volatility hydrocarbon components to maintain the 2% liquid phase at the desired operating temperatures. In that event, an optional heavy hydrocarbon feedstock may be added to form a hydrocarbon feedstock containing salt and/or particulate matter with properties sufficient to maintain the desired liquid fraction at the desired operating conditions.

The optional heavy hydrocarbon feedstock for use with the present invention would preferably contain one or more of atmospheric residue, vacuum residue, a heavier crude oil, heavy non-virgin hydrocarbon streams from refineries, and low sulfur waxy residue. One preferred heavy hydrocarbon feedstock is an economically advantaged, minimally processed heavy hydrocarbon stream containing non-volatile hydrocarbons and/or coke precursors. Another preferred heavy hydrocarbon feedstock for use in this invention is an atmospheric residue, also known as an atmospheric pipestill bottoms stream.

The optional heavy hydrocarbon feedstock will preferably have a higher $T_{50}$ boiling point than the hydrocarbon feedstock containing salt and/or particulate matter, but may have a nominal final boiling point below, equal to, or greater than the nominal final boiling point of the hydrocarbon feedstock containing salt and/or particulate matter. Likewise the initial boiling point of the heavy hydrocarbon feedstock may be lower than, equal to, or greater than the initial boiling point of the hydrocarbon feedstock containing salt and/or particulate matter, but will generally be at least about 56° C. (about 100° F.) higher, more typically at least about 280° C. (about 500° F.), and often more than about 390° C. (about 700° F.) higher.

Preferably, the addition of the heavy hydrocarbon feedstock will result in a hydrocarbon feedstock blend containing salt and/or particulate matter with a $T_{98}$ boiling point at least about 28° C. (about 50° F.) higher than the $T_{98}$ boiling point of the original hydrocarbon feedstock, for example at least about 56° C. (about 100° F.) higher, as a further example at least about 111° C. (about 200° F.) higher, and as yet another example at least about 167° C. (about 300° F.) higher. Preferably, the addition of the heavy hydrocarbon feedstock will also result in a hydrocarbon feedstock blend containing salt and/or particulate matter with a $T_{95}$ boiling point at least about 14° C. (about 25° F.) higher than the $T_{95}$ boiling point of the original hydrocarbon feedstock, such as at least about 28° C. (about 50° F.) for example at least about 56° C. (about 100° F.) higher, as a further example at least about 111° C. (about 200° F.) higher, and as yet another example at least about 167° C. (about 300° F.) higher.

Vapor-liquid equilibrium modeling using computer software, such as PROVISION™ by Simulation Sciences Inc., can be used to determine optimal quantities of a given heavy hydrocarbon feedstock for use with a given hydrocarbon feedstock containing salt and/or particulate matter. Considerations in this determination would be optimization of total fluid velocity to minimize any settling of salt and/or particulate matter particles and maintenance of at least about 2% of the hydrocarbon feedstock blend in the liquid phase.

The heavy hydrocarbon feedstock, when mixed with the hydrocarbon feedstock containing salt and/or particulate matter may be from about 2 to about 75 percent of the mixture of the hydrocarbon feedstock containing salt and/or particulate matter and the heavy hydrocarbon feedstock, for example from about 2% to about 60%, and as a further example from about 10% to about 50%. The percentage of the heavy hydrocarbon feedstock added to the hydrocarbon feedstock containing salt and/or particulate matter can be optimized according to economics and availability of given hydrocarbon streams at any particular time. However, for the purposes of the present invention, it is preferable that the quantity of heavy hydrocarbon feedstock added is sufficient to result in a liquid fraction of at least about 2% of the total flow into the flash/separation vessel, and generally in the range of about 5 up to about 50%, more preferably about 5 up to about 30%. It is noted that the lighter the heavy hydrocarbon feedstock is relative to the hydrocarbon feedstock containing salt and/or particulate matter being used, the more heavy hydrocarbon feedstock will be required for optimal benefit.

Depending on tankage available, the optional heavy hydrocarbon feedstock may be added to the hydrocarbon feedstock containing salt and/or particulate matter in the feedstock storage tanks or at any point prior to introduction of the hydrocarbon feedstock containing salt and/or particulate matter to the convection section of the furnace. In order to maximize the fluid velocity and minimize deposition of salt and/or particulate matter, it is preferable to add the heavy hydrocarbon feedstock prior to any heating of the hydrocarbon feedstock containing salt and/or particulate matter. Preferably, both the heavy hydrocarbon feedstock and the hydrocarbon feedstock containing salt and/or particulate matter are at a sufficient temperature to ensure flowability of both the heavy hydrocarbon feedstock and the blended feedstock upon mixing.

After optionally blending the heavy hydrocarbon feedstock with a partially desalted hydrocarbon feedstock containing salt and/or particulate matter to produce a hydrocarbon feedstock blend containing salt and/or particulate matter, the heating of the hydrocarbon feedstock containing salt and/or particulate matter, or hydrocarbon feedstock blend containing salt and/or particulate matter, can take any form known by those of ordinary skill in the art.

Referring now to FIG. 1, in a preferred embodiment, a source 10 of hydrocarbon feedstock containing salt and/or particulate matter, e.g., mud, provides a stream of feedstock, which can optionally be preheated, typically to a temperature below the boiling point of water at the pressure of the downstream partial desalter, e.g., 185° C. (365° F.) at 1140 kPa (150 psig), through a supply line 12 to which is optionally added water via an inlet nozzle or mixing valve 14. The water/feedstock mixture passes into a partial desalter 16 which is typically a cyclone separator comprising a tangential inlet that spins the mixture to separate it by centrifugal force into a heavier components stream comprising water, salt and mud, which flows out as bottoms taken via line 18 and a hydrocarbons-rich lighter components stream which passes as overhead via line 20 by centrifugal force. The bottoms 18 can be sent for further processing to a dewatering tank 19 from which water and salt are drawn off from line 21. The remaining solids can be drawn off via line 23, and further processed, e.g., by stripping to remove hydrocarbon components, and the stripped solids are disposed of in an environmentally acceptable manner. The overhead taken from the partial desalter is then directed into pyrolysis furnace 22 where the partially desalted stream is preheated in the first convection section by indirect contact of the hydrocarbon feedstock blend containing salt and/or particulate matter in the upper (farthest from the radiant section 24) convection section tube bank 26 of the furnace in convection section 28, with hot flue gases from the radiant section 24 of the furnace. For ease of reference herein, all references to hydrocarbon feedstock containing salt and/or particulate matter, such as particulate matter, subsequent to entry in the first convection section tube bank will be deemed to include any optional heavy hydrocarbon feedstock that has been added to the stream.

Heating in the convection section can be accomplished, by way of non-limiting example, by passing the hydrocarbon feedstock containing salt and/or particulate matter through a bank of heat exchange tubes 26 located within the convection section 28 of the furnace 22. The heated hydrocarbon feedstock containing salt and/or particulate matter typically has a temperature between about 150 (100) and about 340° C. [about 300 (212) and about 650° F.], such as about 160 (130) to about 230° C. [about 325(265) to about 450° F.], for example about 170 (150) to about 220° C. [about 340(300) to about 425° F.]. (The lower temperatures in parentheses are utilized in those instances where the heated hydrocarbon feedstock passes to a partial desalter 30 as detailed below, to avoid boiling within the cyclone, which may not function properly where vapor is present.)

Optionally, the heated hydrocarbon from the upper convection section 28 is passed through a partial desalter 30 which can supplement or substitute for partial desalter 16. Partial desalter 30 is typically a cyclone separator comprising a tangential inlet that spins the mixture to separate it by centrifugal force into a heavier components stream comprising water, salt and/or mud, which settles out as bottoms taken via line 32 and a hydrocarbons-rich lighter components stream which passes as overhead via line 34. The bottoms can be sent for further processing, e.g., stripping to remove hydrocarbon components, and the remaining solids are disposed of in an environmentally acceptable manner.

The preheated feed taken directly from the upper convection section 28 or, alternatively, the overhead taken from the partial desalter via line 34 containing at least some salt and/or particulate matter, can optionally be further heated by return to the convection section via line 35, before being mixed with primary dilution steam and, optionally, a fluid which can be a hydrocarbon, preferably liquid, but optionally vapor, water, steam, or a mixture thereof. The temperature of the fluid can be below, equal to, or above the temperature of the heated feedstock. In one possible embodiment, the fluid latent heat of vaporization can be used to control the hydrocarbon feedstock containing salt and/or particulate matter temperature entering the flash/separation vessel.

The mixing of the heated hydrocarbon feedstock containing salt and/or particulate matter, primary dilution steam, and the optional fluid can occur inside or outside the pyrolysis furnace 22, but preferably it occurs outside the furnace. The mixing can be accomplished using any mixing device known within the art. For example, it is possible to use a first sparger 36 of a double sparger assembly 38 for the mixing. The first sparger 36 can avoid or reduce hammering, caused by sudden vaporization of the fluid, upon introduction of the fluid into the heated hydrocarbon feedstock.

The use of steam and or fluid mixed with the hydrocarbon feedstock containing salt and/or particulate matter is optional for high volatility feedstocks. It is possible that such feedstocks can be heated in any manner known in the industry, for example in heat exchange tubes 26 located within the convection section 28 of the furnace. The hydrocarbon feedstock containing salt and/or particulate matter could be conveyed to the flash/separation vessel with little or no added steam or fluid.

The primary dilution steam 40 can have a temperature greater, lower or about the same as hydrocarbon feedstock containing salt and/or particulate matter mixture but preferably the temperature is about the same as that of the mixture, which is preferably about 350° F. The primary dilution steam 40 may be superheated before being injected into the second sparger 42.

The mixture stream comprising the heated hydrocarbon feedstock containing salt and/or particulate matter, the fluid, and the optional primary dilution steam stream leaving the second sparger 42 is optionally heated further in the convection section 26 of the pyrolysis furnace 22 before the flash. The heating can be accomplished, by way of non-limiting example, by passing the mixture stream through a bank of heat exchange tubes 26 located within the convection section, usually as a lower part 44 of the first convection section tube bank, of the furnace and thus heated by the hot flue gas from the radiant section 24 of the furnace. The thus-heated hydrocarbon feedstock containing salt and/or particulate matter leaves the convection section as part of a mixture stream 46 to optionally be further mixed with an additional steam stream 48.

Optionally, the secondary dilution steam stream 48 can be further split into a flash steam stream 50 which is mixed with the hydrocarbon mixture 46 before the flash and a bypass steam stream 52 which either is injected into the upper section of the flash or bypasses the flash of the hydrocarbon mixture and, instead is mixed with the vapor phase 57 from the flash before the vapor phase is further heated in the lower convection section and then cracked in the radiant section of the furnace. The present invention can operate with all secondary dilution steam 48 used as flash steam 50 with no bypass steam 52. Alternatively, the present invention can be operated with secondary dilution steam 48 directed to bypass steam 52 with no flash steam 50. In a preferred embodiment in accordance with the present invention, the ratio of the flash steam stream 50 to bypass steam stream 52 should be preferably 1:20 to 20:1, and most preferably 1:2 to 2:1. In this embodiment, the flash steam 50 is mixed with the hydrocarbon mixture stream 46 to form a flash stream 54 before the flash in flash/separation vessel 56. Preferably, the secondary dilution steam stream is superheated in a superheater section 58 in the furnace convection section 26 before splitting and mixing with the hydrocarbon mixture. The addition of the flash steam stream 50 to the hydrocarbon mixture stream 46 aids the vaporization of less volatile components of the mixture before the flash stream 54 enters the flash/separation vessel 56.

A second optional fluid can be added to the mixture stream before flashing the mixture stream, the second fluid being a hydrocarbon vapor.

The mixture stream 46 or the flash stream 54 is then flashed, for example in a flash/separation vessel 56, for separation into two phases: a vapor phase comprising predominantly steam and volatile hydrocarbons from the hydrocarbon feedstock containing salt and/or particulate matter and a liquid phase comprising less-volatile hydrocarbons along with the vast majority of the non-volatile components and/or coke precursors and the vast majority of the salt and/or particulate matter. It is understood that vapor-liquid equilibrium at the operating conditions described herein would result in very small quantities of non-volatile components and/or coke precursors present in the vapor phase. Additionally, and varying with the design of the flash/separation vessel, minute quantities of liquid containing non-volatile components and/or salt and/or particulate matter could be entrained in the vapor phase. In the process of this invention, these quantities are sufficiently small to allow decoking downstream of the flash/separation vessel on the same schedule as for decoking in the radiant section of the furnace. The vapor phase can be considered to have substantially no non-volatile components or coke precursors when coke buildup in the convection section between the flash/separation vessel is at a sufficiently low rate that decoking is not required any more frequently than typical decoking required for the radiant section is required.

For ease of description herein, the term flash/separation vessel will be used to mean any vessel or vessels used to separate the hydrocarbon feedstock containing salt and/or particulate matter into a vapor phase and at least one liquid phase. It is intended to include fractionation and any other method of separation, for example, but not limited to, drums, distillation towers, and centrifugal separators.

The mixture stream 46 is preferably introduced tangentially to the flash/separation vessel 56 through at least one side inlet located in the side of said vessel. The vapor phase is preferably removed from the flash/separation vessel as an overhead vapor stream 57. The vapor phase, preferably, is fed back to a convection section tube bank 60 of the furnace, preferably located nearest the radiant section 24 of the furnace 22, for optional heating and is then conveyed through crossover pipes 62 to the radiant section 24 of the pyrolysis furnace for cracking. The liquid phase of the flashed mixture stream is removed from the flash/separation vessel 56, preferably as a bottoms stream 64. The bottoms stream which may contain a portion of salts and/or particulates can be used as fuel, e.g., bunker C fuel oil, feed to a refinery cat cracker or coker unit, without additional desalting.

It is preferred to maintain a predetermined constant ratio of vapor to liquid in the flash/separation vessel 56, but such ratio is difficult to measure and control. As an alternative, the temperature of the mixture stream 46 or, optionally, stream 54 before the flash/separation vessel 56 can be used as an indirect parameter to measure, control, and maintain an approximately constant vapor to liquid ratio in the flash/separation vessel 56. Ideally, when the mixture stream temperature is higher, more volatile hydrocarbons will be vaporized and become available, as part of the vapor phase, for cracking. However, when the mixture stream temperature is too high, more heavy hydrocarbons, including coke precursors, will be present in the vapor phase and carried over to the convection furnace tubes, eventually coking the tubes. If the mixture stream 46 temperature is too low, resulting in a low ratio of vapor to liquid in the flash/separation vessel 56, more volatile hydrocarbons will remain in liquid phase and thus will not be available for cracking.

The mixture stream temperature is controlled to maximize recovery or vaporization of volatiles in the feedstock while avoiding excessive deposition of salt and/or particulate matter or coking in the furnace tubes or in piping and vessels conveying the mixture from the flash/separation vessel 56 to the furnace 22 via line 57. The pressure drop across the piping 57 conveying the mixture to the lower convection section 60, and the crossover piping 62, and the temperature rise across the lower convection section 60 may be monitored to detect the onset of coking problems. For instance, if the crossover pressure and process inlet pressure to the lower convection section 60 begin to increase gradually due to coking, the temperature in the flash/separation vessel 56 and the mixture stream 46 should be reduced. If coking occurs in the lower convection section 60, the temperature of the flue gas increases to the sections above, such as the optional superheater 58. If a superheater 58 is present, the increased flue gas temperature can be offset in part by adding more desuperheater water 66.

The selection of the mixture stream 46 temperature is also determined by the composition of the feedstock materials. When the feedstock contains higher amounts of lighter hydrocarbons, the temperature of the mixture stream 46 can be set lower. When the feedstock contains a higher amount of less- or non-volatile hydrocarbons, the temperature of the mixture stream 46 should be set higher.

Typically, the temperature of the mixture stream 46 can be set and controlled at between about 315 and about 540° C. (about 600 and about 1000° F.), such as between about 370 and about 510° C. (about 700 and about 950° F.), for example between about 400 and about 480° C. (about 750 and about 900° F.), and often between about 430 and about 475° C. (about 810 and about 890° F.). These values will change with the volatility of the feedstock as discussed above.

Considerations in determining the temperature include the desire to maintain a liquid phase to reduce or eliminate the likelihood of solids deposition or coke formation in the flash/separation vessel 56 and associated piping and on convection tubes upstream of the flash/separation vessel 56. Typically, at least about 2%, more preferably about 5%, of the total hydrocarbons are in the liquid phase after being flashed.

It is desirable to maintain a constant temperature for the mixture stream 46 mixing with flash steam 50 and entering the flash/separation vessel to achieve a constant ratio of vapor to liquid in the flash/separation vessel 56, and to avoid substantial temperature and flash vapor to liquid ratio variations. One possible control arrangement is the use of a control system 68 to automatically control the fluid valve 70 and primary dilution steam valve 72 on the two spargers to maintain a set temperature for the mixture stream 46 before the flash/separation vessel 56. When the control system 68 detects a drop of temperature of the mixture stream, it will cause the fluid valve 70 to reduce the injection of the fluid into the first sparger 36. If the temperature of the mixture stream starts to rise, the fluid valve will be opened wider to increase the injection of the fluid into the first sparger 36. It is preferred in the process of this invention that injected water be minimized.

When the primary dilution steam stream 40 is injected to the second sparger 42, the temperature control system 68 can also be used to control the primary dilution steam valve 72 to adjust the amount of primary dilution steam stream injected to the second sparger 42. This further reduces the sharp variation of temperature changes in the flash 56. When the control system 68 detects a drop of temperature of the mixture stream 46, it will instruct the primary dilution steam valve 72 to increase the injection of the primary dilution steam stream into the second sparger 42 while valve 70 is closed more. If the temperature starts to rise, the primary dilution steam valve will automatically close more to reduce the primary dilution steam stream injected into the second sparger 42 while valve 70 is opened wider. In addition to, or instead of sparger steam/water, flue gas excess air ($O_2$) can be used to control the temperature of stream 46.

In an example embodiment, the amount of fluid and primary dilution steam vary to maintain a constant mixture stream 46 temperature, while preferably maintaining a constant ratio of $H_2O$ to feedstock in the mixture 74. However, while water is a preferred fluid for use in this invention, it is generally feasible to operate with no added fluid other than steam. To further avoid sharp variation of the flash temperature, the present invention also preferably utilizes an intermediate desuperheater 76 in the superheating section of the secondary dilution steam in the furnace. This allows the superheater 58 outlet temperature to be controlled at a constant value, independent of furnace load changes, coking extent changes, excess oxygen level changes, and other variables. Normally, this desuperheater 76 maintains the temperature of the secondary dilution steam between about 425 and about 590° C. (about 800 and about 1100° F.), for example between about 455 and about 540° C. (about 850 and about 1000° F.), such as between about 455 and about 510° C. (about 850 and about 950° F.). The desuperheater 76 can be a control valve and water atomizer nozzle. After partial preheating, the secondary dilution steam exits the convection section and a fine mist of desuperheater water 66 can be added which rapidly vaporizes and reduces the temperature. The steam is preferably then further heated in the convection section. The amount of water added to the superheater can control the temperature of the steam, which is mixed with mixture stream 46.

In addition to maintaining a constant temperature of the mixture stream 46 entering the flash/separation vessel 56, it is generally also desirable to maintain a constant hydrocarbon partial pressure of the flash stream 54 in order to maintain a constant ratio of vapor to liquid in the flash/separation vessel 56. By way of examples, the constant hydrocarbon partial pressure can be maintained by maintaining constant flash/separation vessel pressure through the use of control valves 78 on the vapor phase line 57, and by controlling the ratio of steam to hydrocarbon feedstock containing salt and/or particulate matter in stream 54.

Typically, the hydrocarbon partial pressure of the flash stream in the present invention is set and controlled at between about 25 and about 175 kPa (about 4 and about 25 psia), such as between about 35 and about 100 kPa (about 5 and about 15 psia), for example between about 40 and about 75 kPa (about 6 and about 11 psia).

In one embodiment, the flash is conducted in at least one flash/separation vessel 56. Typically the flash is a one-stage process with or without reflux. The flash/separation vessel 56 is normally operated at about 275 to about 1400 kPa (about 40 to about 200 psia) pressure and its temperature is usually the same or slightly lower than the temperature of the flash stream 54 before entering the flash/separation vessel 56. Typically, the pressure at which the flash/separation vessel 56 operates is about 275 to about 1400 kPa (about 40 to about 200 psia), for example about 600 to about 1100 kPa (about 85 to about 155 psia), as a further example about 700 to about 1000 kPa (about 105 to about 145 psia), and in yet another example, the pressure of the flash/separation vessel 56 can be about 700 to about 760 kPa (about 105 to about 125 psia). The temperature at which the flash/separation vessel 56 operates, or the temperature of the inlet stream to the flash/separation vessel, is about 315 to about 560° C. (about 600 to about 1040° F.), such as about 370 to about 490° C. (about 700 to about 920° F.), for example about 400 to about 480° C. (about 750 to about 900° F.). Depending on the temperature of the mixture stream 46, generally about 50 to about 98% of the mixture stream being flashed is in the vapor phase, such as about 70 to about 95%.

The flash/separation vessel 56 is generally operated, in one aspect, to minimize the temperature of the liquid phase at the bottom of the vessel 56 because too much heat may cause coking of any non-volatiles present in the liquid phase. Use of the secondary dilution steam stream 48 in the flash stream entering the flash/separation 56 vessel lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/separation vessel 56 bottoms liquid 80 back to the flash/separator vessel to help cool the newly separated liquid phase at the bottom of the flash/separation vessel 56. Stream 64 can be conveyed from the bottom of the flash/separation vessel 56 to the cooler 82 via pump 84. The cooled stream 86 can then be split into recycle stream 80 and export stream 88. The temperature of the recycled stream 80 would typically be about 260 to about 315° C. (about 500 to about 600° F.), for example about 270 to about 290° C. (about 520 to about 550° F.). The amount of recycled stream 80 can be about 80 to about 250% of the amount of the newly separated bottom liquid inside the flash/separation vessel 56, such as 90 to 225%, for example 100 to 200%.

The flash is generally also operated, in another aspect, to minimize the liquid retention/holding time in the flash/separation vessel 56. In one example embodiment, the liquid phase is discharged from the vessel 56 through a small diameter "boot" or cylinder 90 on the bottom of the flash/separation vessel 56. Typically, the liquid phase retention time in the flash/separation vessel 56 is less than 75 seconds, for example less than 60 seconds, such as less than 30 seconds, and often less than 15 seconds. The shorter the liquid phase retention/holding time in the flash/separation vessel 56, the less coking occurs in the bottom of the flash/separation vessel 56.

The vapor phase leaving the flash/separation vessel 56 may contain, for example, about 55 to about 70% hydrocarbons and about 30 to about 45% steam. The nominal boiling end point of the vapor phase is normally below about 760° C. (about 1400° F.), such as below about 675° C. (about 1250° F.), for example below about 590° C. (about 1100° F.), as a further example below about 565° C. (about 1050° F.), and often below about 540° C. (about 1000° F.). The vapor phase is continuously removed from the flash/separation vessel 56 through an overhead pipe 57, which optionally conveys the vapor to a manifold that distributes the flow to the lower convection section 60 or the radiant section 24 of the furnace 22.

The vapor phase stream 57 continuously removed from the flash/separation vessel 56 is preferably superheated in the pyrolysis furnace 22 lower convection section 60 to a temperature of, for example, about 425 to about 705° C. (about 800 to about 1300° F.) by the flue gas from the radiant section of the furnace. The vapor phase is then conveyed by the crossover piping 62 to the radiant section 24 of the pyrolysis furnace 22 to be cracked to produce an effluent comprising olefins, including ethylene and other desired light olefins, and byproducts.

The vapor phase stream 57 removed from the flash/separation vessel can optionally be mixed with a bypass steam stream 52 before being introduced into the furnace lower convection section 60.

Because the process of this invention can result in significant removal (in the liquid phase 69 leaving the flash/separation vessel 56) of the coke- and tar-producing heavier hydrocarbon species, it may be possible to utilize a transfer line exchanger for quenching the effluent from the radiant section 24 of the pyrolysis furnace 22. Among other benefits, this will allow more cost-effective retrofitting of cracking facilities initially designed for lighter (uncontaminated) feeds, such as naphthas, or other liquid feedstocks with end boiling points generally below about 315° C. (about 600° F.), which have transfer line exchanger quench systems already in place. Copending Provisional Application Ser. No. 60/555,282, filed Mar. 22, 2004, the disclosure of which is fully incorporated herein, details a design for maximizing the benefits associated with use of a transfer line exchanger in conjunction with a process for cracking hydrocarbon feedstocks comprising non-volatile components.

The location and operating temperature of the flash/separation vessel 56 is selected to provide the maximum possible vapor feed which can be processed without excessive fouling/coking concerns. If the ratio of liquid is too high, valuable feed will be lost and the economics of the operation will be detrimentally affected. If the ratio of liquid is too low, deposition of salt and/or particulate matter in the convection tubes and the flash/separation vessel 56 may become a problem.

The percentage of given hydrocarbon feed discharged from the flash/separation vessel 56 as a vapor is a function of the hydrocarbon partial pressure in the flash/separation vessel 56 and of the temperature entering the vessel 56. The temperature of the hydrocarbon feedstock containing salt and/or particulate matter entering the flash/separation vessel 56 is highly dependent on the flue-gas temperature at that point in the convection section 28. This temperature will vary as the furnace load is changed, being higher when the furnace is at full load, and lower when the furnace 22 is at partial load. The flue-gas temperature in the convection section tube banks 26 and 44 are also functions of the extent of coking that has occurred in the furnace 22. When the furnace 22 is clean or lightly coked, heat transfer is improved and the flue-gas temperature at that point is correspondingly cooler than when the furnace 22 is heavily coked. The flue-gas temperature at any point is also a function of the combustion control exercised on the burners of the furnace 22.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for cracking an undesalted hydrocarbon feedstock containing salt and particulate matter, said process performed in sequence comprising:

a. heating said undesalted hydrocarbon feedstock containing salt and particulate matter to provide a heated hydrocarbon feedstock containing salt and particulate matter to a temperature between about 100° C. and about 340° C. in a first convection section tube bank of a pyrolysis furnace;

b. partially desalting by a centrifugal separator said heated hydrocarbon feedstock containing salt and particulate matter to an extent sufficient to avoid accumulation of salt and particulate matter in said liquid phase at levels which interfere with the subsequent intended use of said liquid phase; and further wherein said centrifugal separator is a cyclone separator consisting essentially of a tangential inlet, an upper outlet for removing a partially desalted hydrocarbon stream and a lower outlet for removing bottoms containing water, salt, and/or particulate matter, bottoms and wherein said partially desalted hydrocarbon feedstock contains particulate matter, non-volatiles and about 0.01 wt % to about 0.8 wt % salt;

c. adding to said partially desalted hydrocarbon feedstock (i) steam and optionally water and (ii) a heavy hydrocarbon having a $T_{50}$ boiling point greater than that of the partially desalted hydrocarbon feedstock to produce a hydrocarbon blend having a $T_{98}$ boiling point that is at least about 28° C. greater than that of the undesalted hydrocarbon feedstock, the heavy hydrocarbon being about 10.0 wt % to about 50.0 wt % of the weight of the hydrocarbon blend;

d. feeding the hydrocarbon blend to a flash/separation vessel, about 5 wt %, to about 30 wt % of the hydrocarbon blend being liquid at the flash/separation vessel's inlet;

e. separating the hydrocarbon blend into a vapor phase and a liquid phase in the flash/separation vessel, wherein vapor liquid split is controlled by i) varying the amount of added steam and/or water added to the partially desalted hydrocarbon feedstock, and/or ii) the amount of heavy hydrocarbon fluid combined with the partially desalted hydrocarbon feedstock, such that the vapor phase is less than 98% by weight of the hydrocarbon blend, said liquid phase comprising a sufficient portion of the hydrocarbon blend to maintain salt and particulate matter in suspension;

f. removing the vapor phase from the flash/separation vessel; and g. cracking the vapor phase to produce an effluent comprising olefins.

2. The process of claim 1, wherein said partial desalting is carried out in the absence of an electrostatic charge.

3. The process of claim 1, wherein said bottoms are removed to a dewatering tank to separate particulate matter from said water and salt.

4. The process of claim 3, wherein said particulate matter is treated to at least partially remove hydrocarbons.

5. The process of claim 1, wherein said partial desalting removes greater than about 25 wt % of said salt and/or particulate matter.

6. The process of claim 1, wherein said partial desalting removes between 25 wt % and 90 wt % of said salt and/or particulate matter.

7. The process of claim 1, which further comprises mixing wash water with said hydrocarbon feedstock prior to said partial desalting.

8. The process of claim 7, wherein said mixing is accomplished by adding said wash water through a nozzle.

9. The process of claim 7, wherein said mixing is accomplished by a mixing valve.

10. The process of claim 1, wherein steam is added at any step or steps prior to step (f).

11. The process of claim 1, wherein after separation of said hydrocarbon feedstock into a vapor phase and a liquid phase, at least 2% of said hydrocarbon blend is in the liquid phase.

12. The process of claim 10, wherein the steam comprises sour or treated process steam.

13. The process of claim 10, wherein the steam is superheated in the convection section of the pyrolysis furnace.

14. The process of claim 10, wherein said partially desalted hydrocarbon feedstock is mixed with a fluid in addition to steam prior to step (f).

15. The process of claim 1, wherein the partially desalted hydrocarbon feedstock is heated by indirect contact with flue gas in the first convection section tube bank of the pyrolysis furnace before adding steam in step (c).

16. The process of claim 15, wherein the partially desalted hydrocarbon feedstock is heated by indirect contact with flue gas in a second convection section tube bank of the pyrolysis furnace before step (d).

17. The process of claim 1, wherein the temperature of the partially desalted hydrocarbon feedstock during step (d) is from about 315 to about 560° C. (about 600 to about 1040° F.).

18. The process of claim 1, wherein the vapor phase temperature entering the radiant section of the pyrolysis furnace is from about 425 to about 705° C. (about 800 to about 1300° F.).

19. A process for cracking a hydrocarbon feedstock containing salt, said process comprising:

a. heating said hydrocarbon feedstock containing salt to a first temperature to a temperature between about 100° C. and about 340° C. in a first convection section tube bank of a pyrolysis furnace;

b. partially desalting the heated hydrocarbon feedstock to produce a partially desalted hydrocarbon and then adding steam and/or water to the partially desalted hydrocarbon feedstock and (ii) adding a heavy hydrocarbon having a $T_{50}$ boiling point greater than that of the partially desalted hydrocarbon feedstock to produce a hydrocarbon blend having a $T_{98}$ boiling point that is at least about 28° C. greater than that of the hydrocarbon feedstock, the heavy hydrocarbon being about 10.0 wt % to about 50.0 wt % of the weight of the hydrocarbon blend;

c. further heating the hydrocarbon blend to a second temperature greater than the first temperature, said second temperature being such that a sufficient portion of the hydrocarbon blend remains in the liquid phase to maintain salt in suspension;

d. feeding the hydrocarbon blend to a flash/separation vessel, about 5 wt % to about 30 wt % of the hydrocarbon blend being liquid at the flash/separation vessel's inlet;

e. separating the hydrocarbon blend into a vapor phase and a liquid phase in the flash/separation vessel, wherein vapor liquid split is controlled by i) varying the amount of steam and/or water added to the partially desalted hydrocarbon feedstock, and/or ii) the amount of the heavy hydrocarbon combined with the partially desalted hydrocarbon feedstock, such that 2% to 5% of the hydrocarbon blend is in the liquid phase after separation said liquid phase being rich in salt and said vapor phase being substantially depleted of salt;

f. removing the vapor phase from the flash/separation vessel;

g. adding steam to the vapor phase;

h. cracking the vapor phase in a radiant section of a pyrolysis furnace to produce an effluent comprising olefins, said pyrolysis furnace comprising a radiant section and a convection section; wherein the partial desalting of step b) is of an extent sufficient to avoid accumulation of salt in said liquid phase at levels which interfere with the subsequent intended use of said liquid phase, wherein said partial desalting is carried out by a centrifugal separator which is a cyclone separator consisting essentially of a tangential inlet, an upper outlet for removing the partially desalted hydrocarbon feedstock and a lower outlet for removing bottoms containing water, salt and/or particulate matter bottoms; wherein said partially desalted hydrocarbon feedstock contains from about 0.01 to about 0.8 wt % salt.

20. The process of claim 19, which further comprises mixing wash water with said hydrocarbon feedstock prior to said partial desalting.

21. The process of claim 1, wherein partially desalting of step (b) of said hydrocarbon feedstock containing salt and particulate matter is to an extent sufficient to avoid deposition of salt and particulate matter, by the feed upstream of the flash separation vessel.

22. The process of claim 19, wherein partially desalting comprises partially desalting to an extent sufficient to avoid deposition of salt and particulate matter, by the feed upstream of the flash separation vessel.

23. The process of claim 19, further comprising partially desalting said hydrocarbon feedstock prior to step (a).

24. The process of claim 23, wherein said hydrocarbon feed is an undesalted hydrocarbon feedstock.

25. The process of claim 19, wherein said hydrocarbon feedstock containing salt and particulate matter is heated in step (a) by indirect contact with flue gas in a first convection section tube bank of the pyrolysis furnace.

26. The process of claim 25, wherein said partially desalted hydrocarbon feedstock is heated in step (c) by indirect contact with flue gas in a second convection section tube bank of the pyrolysis furnace.

27. The process of claim 19, wherein said partially desalted hydrocarbon feedstock contains from about 0.1 to about 0.5 wt % salt and/or particulate matter.

28. The process of claim 1, wherein said partially desalted hydrocarbon feedstock contains from about 0.1 to about 0.5 wt % salt and/or particulate matter.

* * * * *